US010465479B2

(12) United States Patent
Davis et al.

(10) Patent No.: US 10,465,479 B2
(45) Date of Patent: Nov. 5, 2019

(54) EROSION PROTECTION FOR CLOSING SLEEVE ASSEMBLIES

(71) Applicant: Halliburton Energy Services, Inc., Houston, TX (US)

(72) Inventors: Jason Earl Davis, Rowlett, TX (US); Phil Terry Thomas, The Colony, TX (US); William Mark Richards, Flower Mound, TX (US); Thomas Jules Frosell, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/754,996

(22) PCT Filed: Sep. 29, 2015

(86) PCT No.: PCT/US2015/052935

§ 371 (c)(1),
(2) Date: Feb. 23, 2018

(87) PCT Pub. No.: WO2017/058171

PCT Pub. Date: Apr. 6, 2017

(65) Prior Publication Data

US 2018/0363418 A1 Dec. 20, 2018

(51) Int. Cl.

| | |
|---|---|
| ***E21B 34/10*** | (2006.01) |
| ***E21B 34/14*** | (2006.01) |
| ***E21B 43/04*** | (2006.01) |

(52) U.S. Cl.

CPC ..... *E21B 34/14* (2013.01); *E21B 34/10* (2013.01); *E21B 43/04* (2013.01)

(58) Field of Classification Search

CPC ..... E21B 34/10; E21B 34/14; E21B 43/04
See application file for complete search history.

(56) References Cited

U.S. PATENT DOCUMENTS 3,094,307 A * 6/1963 Alley ..... E21B 34/14 137/625.38

3,973,587 A 8/1976 Cochran (Continued)

FOREIGN PATENT DOCUMENTS

WO 2012/037645 3/2012

OTHER PUBLICATIONS

International Search Report and Written Opinion for PCT Patent Application No. PCT/US2015/052935, dated Jun. 28, 2016; 16 pages, dated Jun. 28, 2016.

*Primary Examiner* — Matthew R Buck
(74) *Attorney, Agent, or Firm* — Baker Botts L.L.P.

(57) ABSTRACT

An erosion protection system for closing sleeve assemblies is disclosed. A closing sleeve assembly including a housing; a port formed in the housing; a sealing surface formed in the housing adjacent to the port; a closing sleeve configured to move between an open position, in which a fluid flow through the port is permitted, and a closed position, in which the fluid flow through the port is prevented, the closing sleeve including a seal configured to engage with the sealing surface to form a fluid and pressure tight seal when the closing sleeve is in the closed position; and a protective sleeve configured to extend toward the port to substantially cover the sealing surface when the closing sleeve is moved to the open position and retract away from the port when the closing sleeve is moved to the closed position.

20 Claims, 3 Drawing Sheets

(56) References Cited

U.S. PATENT DOCUMENTS

| | | | | |
|---|---|---|---|---|
| 4,246,968 | A | 1/1981 | Jessup et al. | |
| 6,273,194 | B1 * | 8/2001 | Hiron | E21B 34/066 166/332.1 |
| 6,325,150 | B1 * | 12/2001 | Rayssiguier | E21B 34/06 166/334.4 |
| 6,457,541 | B1 | 10/2002 | Schoeffler | |
| 6,491,097 | B1 | 12/2002 | Oneal et al. | |
| 7,546,879 | B2 * | 6/2009 | Cantin | E21B 21/103 166/241.6 |
| 7,556,102 | B2 | 7/2009 | Gomez | |
| 8,141,634 | B2 | 3/2012 | Fisher et al. | |
| 8,267,178 | B1 | 9/2012 | Sommers et al. | |
| 2010/0319779 | A1 | 12/2010 | Harms et al. | |
| 2012/0073828 | A1 | 3/2012 | Churchill | |
| 2012/0097386 | A1 | 4/2012 | Ward et al. | |
| 2012/0247767 | A1 | 10/2012 | Themig et al. | |
| 2013/0233535 | A1 | 9/2013 | Pacey | |
| 2014/0202768 | A1 | 7/2014 | Noske | |

* cited by examiner

EROSION PROTECTION FOR CLOSING SLEEVE ASSEMBLIES

RELATED APPLICATIONS

This application is a U.S. National Stage Application of International Application No. PCT/US2015/052935 filed Sep. 29, 2015, which designates the United States, and which is incorporated herein by reference in its entirety.

TECHNICAL FIELD

The present disclosure is related to downhole tools for use in a wellbore environment and more particularly to closing sleeve assemblies used in a well system during gravel packing operations.

BACKGROUND OF THE DISCLOSURE

Production fluids, including hydrocarbons, water, sediment, and other materials or substances found in a downhole formation, flow out of the surrounding formation into a wellbore and then ultimately out of the wellbore. Sand and other fine particulates are often carried from the formation into the wellbore by the production fluids. During well completion, a steel screen is placed in the wellbore and the surrounding annulus is packed with gravel to inhibit particulate flow from the formation.

BRIEF DESCRIPTION OF THE DRAWINGS

A more complete and thorough understanding of the various embodiments and advantages thereof may be acquired by referring to the following description taken in conjunction with the accompanying drawings, in which like reference numbers indicate like features, and wherein.

DETAILED DESCRIPTION OF THE DISCLOSURE

To protect the sealing surface in a closing sleeve assembly from erosion caused by the proppant-laden slurry flowing over the surface, a protective sleeve may be positioned over the sealing surface. Embodiments of the present disclosure and its advantages may be understood by referring to FIGS. 1 through 5, where like numbers are used to indicate like and corresponding parts.

Figure 1:
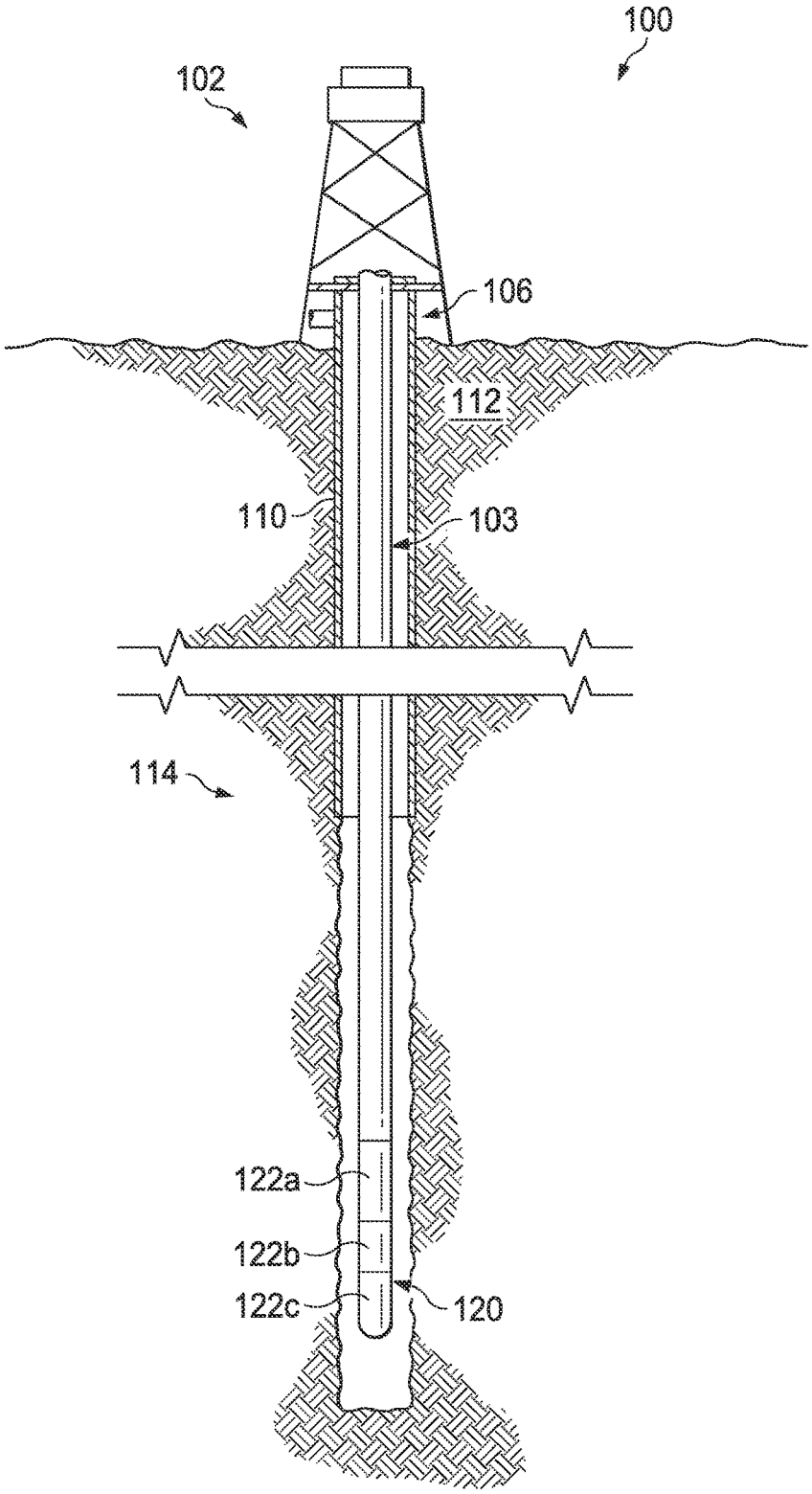
FIG. 1 is an elevation view of a well system.

FIG. 1 is an elevation view of a well system. Well system 100 includes well surface or well site 106. Various types of equipment such as a rotary table, drilling fluid or production fluid pumps, drilling fluid tanks (not expressly shown), and other drilling or production equipment may be located at well surface or well site 106. For example, well site 106 may include drilling rig 102 that may have various characteristics and features associated with a land drilling rig. However, downhole assemblies incorporating teachings of the present disclosure may be satisfactorily used with drilling equipment located on offshore platforms, drill ships, semi-submersibles and drilling barges (not expressly shown).

Well system 100 may also include production string 103, which may be used to produce hydrocarbons such as oil and gas and other natural resources such as water from formation 112 via wellbore 114. Production string 103 may also be used to inject hydrocarbons such as oil and gas and other natural resources such as water into formation 112 via wellbore 114. As shown in FIG. 1, wellbore 114 is substantially vertical (e.g., substantially perpendicular to the surface). Although not illustrated in FIG. 1, portions of wellbore 114 may be substantially horizontal (e.g., substantially parallel to the surface), or at an angle between vertical and horizontal.

The location of various components may be described relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Well system 100 may also include downhole assembly 120 coupled to production string 103. Downhole assembly 120 may be used to perform operations relating to the completion of wellbore 114, production of hydrocarbons and other natural resources from formation 112 via wellbore 114, injection of hydrocarbons and other natural resources into formation 112 via wellbore 114, and/or maintenance of wellbore 114. Downhole assembly 120 may be located at the end of wellbore 114 or at a point uphole from the end of wellbore 114. Downhole assembly 120 may be formed from a wide variety of components configured to perform these operations. For example, components 122*a*, 122*b* and 122*c* of downhole assembly 120 may include, but are not limited to, screens, flow control devices, slotted tubing, packers, valves, sensors, and actuators. The number and types of components 122 included in downhole assembly 120 may depend on the type of wellbore, the operations being performed in the wellbore, and anticipated wellbore conditions.

Fluids, including hydrocarbons, water, and other materials or substances, may be injected into wellbore 114 and formation 112 via production string 103 and downhole assembly 120. For example, during gravel pack operations a proppant-laden slurry including proppant particles mixed with a fluid may be injected into wellbore 114 via downhole assembly 120 and production string 103. In other examples, a temporary string (not expressly shown) that is part of the service tool string may be used in place of production string 103. The proppant particles may include naturally occurring sand grains, man-made or specially engineered particles, such as resin-coated sand or high-strength ceramic materials like sintered bauxite. The proppant-laden slurry flows out of downhole assembly 120 through a port (shown in FIGS. 2-5). The flow of the proppant-laden slurry through the port is controlled by a closing sleeve (shown in FIGS. 2-5). For example, in the closed position, the closing sleeve extends to cover the port and form a fluid and pressure tight seal with surfaces adjacent to the port, thus preventing the proppant-laden slurry from flowing through the port. In the open position, the closing sleeve is retracted to permit the proppant-laden slurry to flow through the port.

The flow of the proppant-laden slurry through the port may cause the surfaces of downhole assembly 120 over which the proppant-laden slurry flows to erode. Surface erosion may be particularly problematic where the eroded surface is a sealing surface. For example, the flow of the proppant-laden slurry over surfaces adjacent to the port may erode the surfaces and thus alter the texture and/or profile of the surfaces, which may inhibit the closing sleeve from forming a fluid and pressure tight seal with surfaces adjacent to the port. To protect sealing surfaces from erosion caused by a proppant-laden slurry flowing over the surface, a protective sleeve (shown in FIGS. 2-5) may be positioned over the sealing surface. The use of such a protective sleeve is discussed in detail in conjunction with FIGS. 2-5.

Figure 2:
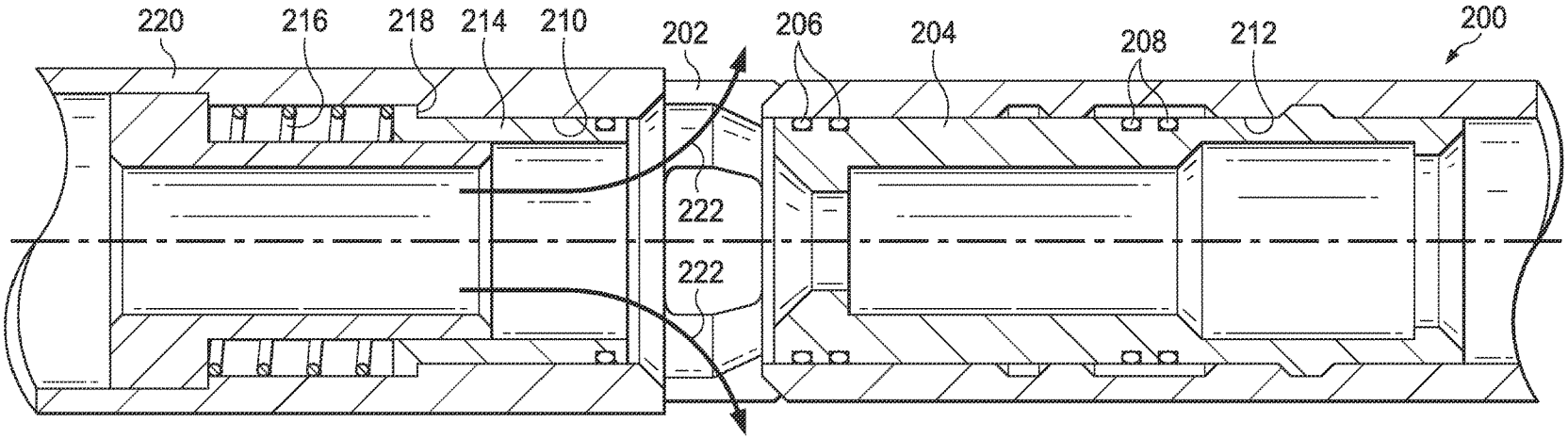
FIG. 2 is a cross-sectional view of a closing sleeve assembly including a protective sleeve in an extended position and a closing sleeve in an open position.
Figure 3:
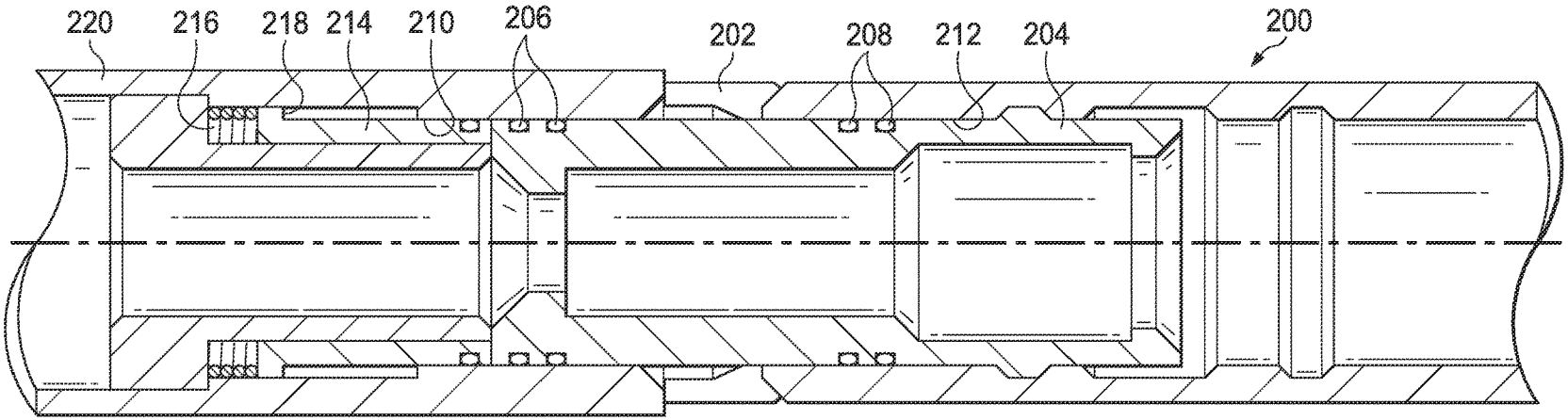
FIG. 3 is a cross-sectional view of a closing sleeve assembly including a protective sleeve in a retracted position and a closing sleeve in a closed position.

FIGS. 2 and 3 are cross-sectional views of a closing sleeve assembly including a protective sleeve and a closing sleeve. Specifically, FIG. 2 is a cross-sectional view of a closing sleeve assembly including a protective sleeve in an extended position and a closing sleeve in an open position, and FIG. 3 is a cross-sectional view of a closing sleeve assembly including a protective sleeve in a retracted position and a closing sleeve in a closed position.

As shown in FIGS. 2 and 3, closing sleeve assembly 200 includes port 202 through which a proppant-laden slurry flows into wellbore 114 (shown in FIG. 1). Closing sleeve assembly 200 also includes closing sleeve 204, which may be moved between an open position (shown in FIG. 2), in which the proppant-laden slurry flows through port 202, and a closed position (shown in FIG. 3) in which the proppant-laden slurry is prevented from flowing through port 202 and wellbore fluids are prevented from entering closing sleeve assembly 200 through port 202. Closing sleeve assembly 200 further includes protective sleeve 214. Protective sleeve 214 may be coupled to spring 216, which permits protective sleeve 214 to extend (shown in FIG. 2) and retract (shown in FIG. 3) as closing sleeve 204 is moved between an open position (shown in FIG. 2) and a closed position (shown in FIG. 3). Spring 216 may be a wave spring, compression spring, or any other type of spring operable to permit protective sleeve 214 to extend and retract as closing sleeve 204 is moved between the open and closed positions shown in FIGS. 2 and 3.

Figure 4:
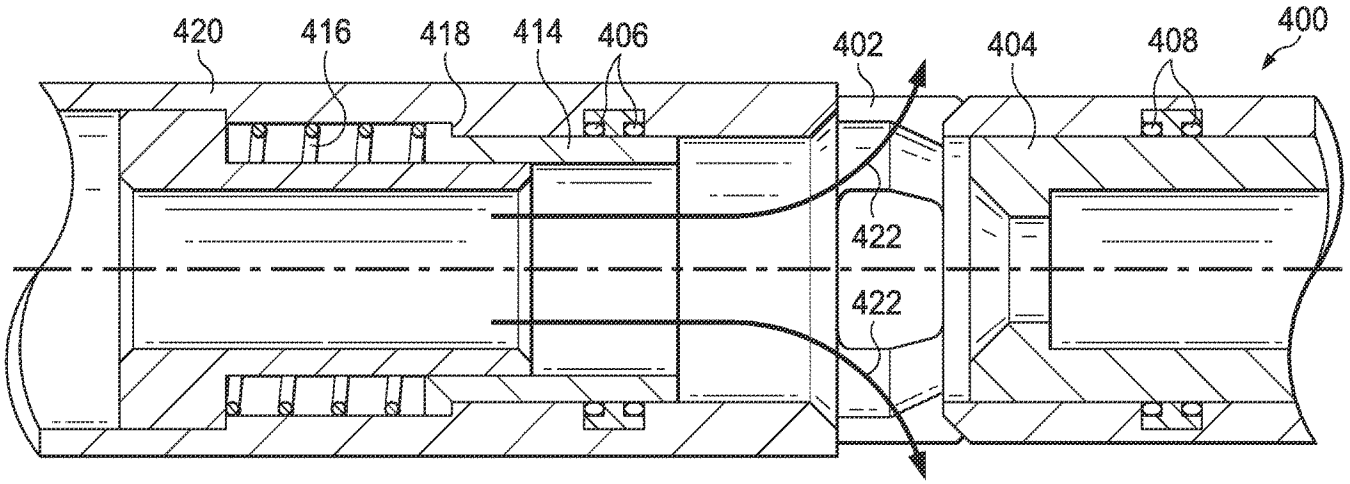
FIG. 4 is a cross-sectional view of a closing sleeve assembly including seals recessed into a housing, a protective sleeve in an extended position, and a closing sleeve in an open position.
Figure 5:
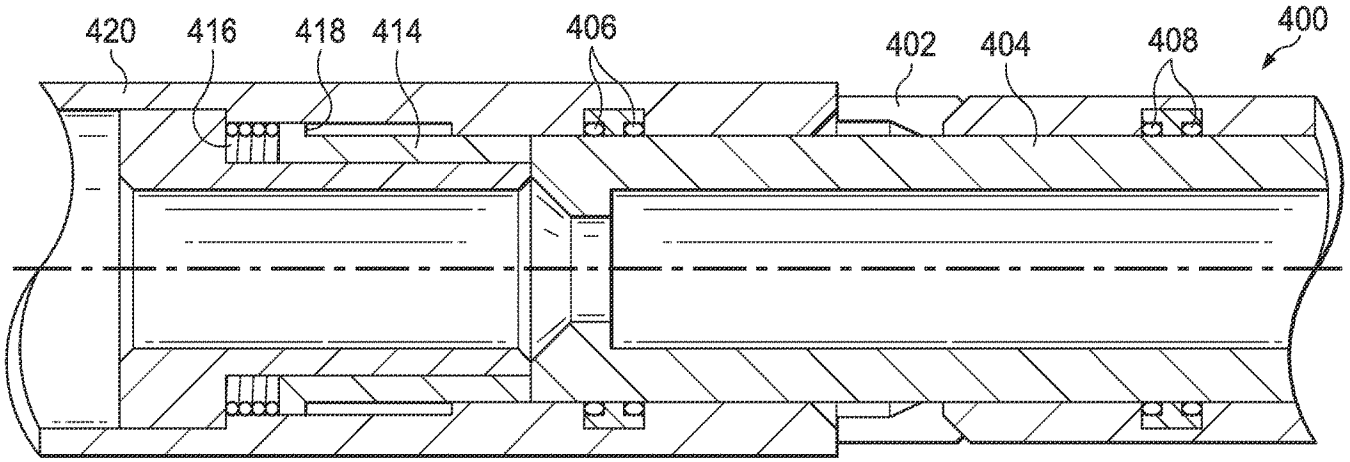
FIG. 5 is a cross-sectional view of a closing sleeve assembly including seals recessed into a housing, a protective sleeve in a refracted position, and a closing sleeve in a closed position.

Closing sleeve 204 may include seals 206 and 208. When closing sleeve 204 is in the closed position (shown in FIG. 3), seals 206 and 208 engage with sealing surfaces 210 and 212 (respectively) to form a fluid and pressure tight seal, thus preventing proppant-laden slurry and wellbore fluids from flowing through port 202. Further, although closing sleeve 204 is illustrated in FIGS. 2 and 3 as including seals 206 and 208, such seals may be separate from closing sleeve 204 (as shown in FIGS. 4 and 5). Seals 206 and 208 may be a molded seal, such as an O-ring, and may be made of an elastomeric material or a non-elastomeric material such as a thermoplastic including, for example, polyether ether ketone (PEEK) or Teflon®. The elastomeric material may be formed from compounds including, but not limited to, natural rubber, nitrile rubber, hydrogenated nitrile, urethane, polyurethane, fluorocarbon, perflurocarbon, propylene, neoprene, hydrin, etc. Although two seals 206 are depicted in FIGS. 2 and 3, any number of seals 206 may be used. Similarly, although two seals 208 are depicted in FIGS. 2 and 3, any number of seals 208 may be used.

When closing sleeve 204 is in the open position (shown in FIG. 2), proppant-laden slurry flows over sealing surface 210 and through port 202. The direction of fluid flow is shown by arrows 222. The flow of proppant-laden slurry over sealing surface 210 may cause sealing surface 210 to erode. Erosion of sealing surface 210 may alter the texture and/or profile of sealing surface 210, which may inhibit seals 206 from forming a fluid and pressure tight seal with sealing surface 210. To reduce the level of contact between sealing surface 210 and the proppant-laden slurry, and thus the erosion of sealing surface 210, protective sleeve 214 extends to cover sealing surface 210 when closing sleeve 204 is in the open position (shown in FIG. 2). Protective sleeve 214 may be formed of an erosion resistant material, including but not limited to tungsten carbide and hardened tool steel. Protective sleeve 214 may also include an erosion resistant coating. For example, protective sleeve 214 may include a base formed of a metal or alloy and two which an erosion resistant coating has been applied. The erosion resistant coating may, for example, include Nedox®, Hardide®, or a coating treated to be erosion resistant through methods including, for example, laser cladding, quench polish quench (QPQ) treatment, and nitro-carburizing.

When closing sleeve 204 is in the open position (shown in FIG. 2), spring 216 exerts a force on protective sleeve 214 that causes protective sleeve 214 to extend towards port 202 and cover sealing surface 210, thus reducing the level of contact between sealing surface 210 and the proppant-laden slurry flowing through port 202. Protective sleeve 214 includes shoulder 218 that engages with housing 220 to prevent protective sleeve 214 from extending too far toward port 202 and obstructing the flow of the proppant-laden slurry through port 202. Additionally, the movement of protective sleeve 214 prevents debris from entering the annular space between protective sleeve 214 and sealing surface 210 while the slurry is being pumped.

When closing sleeve 204 is moved into a closed position (as shown in FIG. 3), closing sleeve 204 contacts protective sleeve 214, causing spring 216 to compress and protective sleeve 214 to retract away from port 202. Protective sleeve 214 may also include wiper 218. As protective sleeve 214 retracts, wiper 218 contacts sealing surface 210. The movement of wiper 218 across sealing surface 210 clears debris from sealing surface 210. The removal of debris from sealing surface 210 may improve the ability of seals 206 of closing sleeve 204 to form a fluid and pressure tight seal with sealing surface 210. Wiper 218 may be formed of an elastomeric material or a non-elastomeric material such as a thermoplastic including, for example, polyether ether ketone (PEEK) or Teflon®. The elastomeric material may be compounds including, but not limited to, natural rubber, nitrile rubber, hydrogenated nitrile, urethane, polyurethane, fluorocarbon, perflurocarbon, propylene, neoprene, hydrin, etc.

FIGS. 4 and 5 are cross-sectional views of a downhole assembly including seals recessed into a sealing surface, a protective sleeve, and a closing sleeve. Specifically, FIG. 4 is a cross-sectional view of a downhole assembly including seals recessed into a housing, a protective sleeve in a refracted position, and a closing sleeve in a closed position, and FIG. 5 is a cross-sectional view of a downhole assembly including seals recessed into a housing, a protective sleeve in an extended position, and a closing sleeve in an open position.

As shown in FIGS. 4 and 5, closing sleeve assembly 400 includes port 402 through which a proppant-laden slurry may flow into wellbore 114 (shown in FIG. 1). Closing sleeve assembly 400 also includes closing sleeve 404, which may be moved between an open position (shown in FIG. 4), in which the proppant-laden slurry flows through port 402, and a closed position (shown in FIG. 5) in which proppant-laden slurry and wellbore fluids are prevented from flowing through port 402. The direction of fluid flow is shown by arrows 222. Closing sleeve assembly 400 further includes protective sleeve 414. Protective sleeve 414 is coupled to spring 416, which permits protective sleeve 414 to extend (shown in FIG. 4) and retract (shown in FIG. 5) as closing sleeve 404 is moved between an open position (shown in FIG. 4) and a closed position (shown in FIG. 5). Spring 416 may be a wave spring, compression spring, or any other type of spring operable to permit protective sleeve 414 to extend and retract as closing sleeve 404 is moved between the open and closed positions shown in FIGS. 4 and 5.

When closing sleeve 404 is in the closed position (shown in FIG. 5), it engages with seals 406 and 408 to form a fluid and pressure tight seal, thus preventing proppant-laden slurry and wellbore fluids from flowing through port 402. Seals 406 and 408 may be positioned in slots or grooves formed in housing 420 or, in embodiments where housing 420 is formed of more than one section, between the sections of housing 420. Seals 406 and 408 may be a molded seal made of an elastomeric material or a non-elastomeric material such as a thermoplastic including, for example, polyether ether ketone (PEEK) or Teflon®. For example, seals 406 and 408 may be an o-ring, vee pack, or molded seal of any other suitable shape. The elastomeric material may be formed from compounds including, but not limited to, natural rubber, nitrile rubber, hydrogenated nitrile, urethane, polyurethane, fluorocarbon, perflurocarbon, propylene, neoprene, hydrin, etc. Although two seals 406 are depicted in FIGS. 4 and 5, any number of seals 406 may be used. Similarly, although two seals 408 are depicted in FIGS. 4 and 5, any number of seals 408 may be used.

When closing sleeve 404 is in the open position (shown in FIG. 4), proppant-laden slurry flows through port 402 and over seals 406. The flow of proppant-laden slurry over seals 406 may cause seals 406 to erode or be damaged. Erosion of or damage to seals 406 may inhibit seals 406 from forming a fluid and pressure tight seal with closing sleeve 404. To reduce the level of contact between seals 406 and the proppant-laden slurry, and thus reduce the likelihood of erosion of or damage to seals 406, protective sleeve 414 extends to cover seals 406 when closing sleeve 404 is in the open position (shown in FIG. 4). Protective sleeve 414 may be formed of an erosion resistant material, including but not limited to tungsten carbide and hardened tool steel. Protective sleeve 414 may also include an erosion resistant coating. For example, protective sleeve 414 may include a base formed of a metal or alloy and two which an erosion resistant coating has been applied. The erosion resistant coating may, for example, include Nedox®, Hardide®, or a coating treated to be erosion resistant through methods including, for example, laser cladding, quench polish quench (QPQ) treatment, and nitro-carburizing.

When closing sleeve 404 is in the open position (shown in FIG. 4), spring 416 exerts a force on protective sleeve 414 that causes protective sleeve 414 to extend towards port 402 and cover seals 406, thus reducing the level of contact between seals 406 and the proppant-laden slurry flowing through port 402. Protective sleeve 414 includes shoulder 418 that engages with housing 420 to prevent protective sleeve 414 from extending too far toward port 402 and obstructing the flow of the proppant-laden slurry through port 402. When closing sleeve 404 is moved into a closed position (as shown in FIG. 5), closing sleeve 404 contacts protective sleeve 414, causing spring 416 to compress and protective sleeve 414 to retract away from port 402.

Embodiments disclosed herein include:

A. A closing sleeve assembly including a housing; a port formed in the housing; a sealing surface formed in the housing adjacent to the port; a closing sleeve configured to move between an open position, in which a fluid flow through the port is permitted, and a closed position, in which the fluid flow through the port is prevented, the closing sleeve including a seal configured to engage with the sealing surface to form a fluid and pressure tight seal when the closing sleeve is in the closed position; and a protective sleeve configured to extend toward the port to substantially cover the sealing surface when the closing sleeve is moved to the open position and retract away from the port when the closing sleeve is moved to the closed position.

B. A closing sleeve assembly including a housing; a port formed in the housing; a seal disposed in a recess formed in the housing; a closing sleeve configured to move between an open position, in which a fluid flow through the port is permitted, and a closed position, in which the fluid flow through the port is prevented, the closing sleeve configured to engage with the seal to form a fluid and pressure tight seal when the closing sleeve is in the closed position; and a protective sleeve configured to extend toward the port to substantially cover the seal when the closing sleeve is moved to the open position and retract away from the port when the closing sleeve is moved to the closed position.

C. A well system including a production string; and a closing sleeve assembly coupled to and disposed downhole from the production string. The closing sleeve assembly includes a housing; a port formed in the housing; a closing sleeve configured to move between an open position, in which a fluid flow through the port is permitted, and a closed position, in which the fluid flow through the port is prevented; and a protective sleeve configured to extend toward the port when the closing sleeve is moved to the open position and retract away from the port when the closing sleeve is moved to the closed position.

Each of embodiments A, B, and C may have one or more of the following additional elements in any combination: Element 1: further comprising a spring coupled to the protective sleeve and configured to exert a force on the protective sleeve in the direction of the port. Element 2: wherein the protective sleeve further comprises a shoulder configured to engage with the housing to prevent the protective sleeve from extending to cover the port. Element 3: wherein the closing sleeve is configured to contact the protective sleeve as the closing sleeve moves to the closed position causing the protective sleeve to retract away from the port. Element 4: wherein the protective sleeve further comprises a wiper configured to contact the sealing surface as the protective sleeve extends and retracts. Element 5: wherein the protective sleeve is formed of an erosion resistant material. Element 6: wherein the protective sleeve is coated with an erosion resistant coating. Element 7: wherein the seal is positioned in a slot or groove formed in the housing adjacent to the port. Element 8: the closing sleeve assembly further including a sealing surface formed in the housing adjacent to the port; the closing sleeve including a seal configured to engage with the sealing surface to form a fluid and pressure tight seal when the closing sleeve is in the closed position; and the protective sleeve is further configured to substantially cover the sealing surface when the closing sleeve is in the open position. Element 9: the closing sleeve assembly further including a seal disposed in a recess formed in the housing; the closing sleeve configured to engage with the seal to form a fluid and pressure tight seal when the closing sleeve is in the closed position; and the protective sleeve configured to substantially cover the seal when the closing sleeve is in the open position.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A closing sleeve assembly, comprising:

a housing;

a port formed in the housing;

a sealing surface formed in the housing adjacent to the port;

a closing sleeve configured to move between an open position, in which a fluid flow through the port is permitted, and a closed position, in which the fluid flow through the port is prevented, the closing sleeve including a seal configured to engage with the sealing surface to form a fluid and pressure tight seal when the closing sleeve is in the closed position; and a protective sleeve configured to extend toward the port to substantially cover the sealing surface when the closing sleeve is moved to the open position and retract away from the port when the closing sleeve is moved to the closed position.

2. The closing sleeve assembly of claim 1, further comprising a spring coupled to the protective sleeve and configured to exert a force on the protective sleeve in the direction of the port.

3. The closing sleeve assembly of claim 1, wherein the protective sleeve further comprises a shoulder configured to engage with the housing to prevent the protective sleeve from extending to cover the port.

4. The closing sleeve assembly of claim 1, wherein the closing sleeve is configured to contact the protective sleeve as the closing sleeve moves to the closed position causing the protective sleeve to retract away from the port.

5. The closing sleeve assembly of claim 1, wherein the protective sleeve further comprises a wiper configured to contact the sealing surface as the protective sleeve extends and retracts.

6. The closing sleeve assembly of claim 1, wherein the protective sleeve includes at least one of an erosion resistant material or an erosion resistant coating.

7. A closing sleeve assembly, comprising:

a housing;

a port formed in the housing;

a seal disposed in a recess formed in the housing;

a closing sleeve configured to move between an open position, in which a fluid flow through the port is permitted, and a closed position, in which the fluid flow through the port is prevented, the closing sleeve configured to engage with the seal to form a fluid and pressure tight seal when the closing sleeve is in the closed position; and a protective sleeve configured to extend downhole toward the port to substantially cover the seal when the closing sleeve is moved from the closed position to the open position and retract away from the port when the closing sleeve is moved to the closed position.

8. The closing sleeve assembly of claim 7, further comprising a spring coupled to the protective sleeve and configured to exert a force on the protective sleeve in the direction of the port.

9. The closing sleeve assembly of claim 7, wherein the protective sleeve further comprises a shoulder configured to engage with the housing to prevent the protective sleeve from extending to cover the port.

10. The closing sleeve assembly of claim 7, wherein the closing sleeve is configured to contact the protective sleeve as the closing sleeve moves to the closed position causing the protective sleeve to retract away from the port.

11. The closing sleeve assembly of claim 7, wherein the seal is positioned in a slot or groove formed in the housing adjacent to the port.

12. The closing sleeve assembly of claim 7, wherein the protective sleeve includes at least one of an erosion resistant material or an erosion resistant coating.

13. A well system comprising:

a production string; and a closing sleeve assembly coupled to and disposed downhole from the production string, the closing sleeve assembly comprising:

a housing;

a port formed in the housing;

a closing sleeve configured to move between an open position, in which a fluid flow through the port is permitted, and a closed position, in which the fluid flow through the port is prevented; and a protective sleeve configured to extend downhole toward the port when the closing sleeve is moved from the closed position to the open position and retract away from the port when the closing sleeve is moved to the closed position.

14. The well system of claim 13, the closing sleeve assembly further comprising:

a sealing surface formed in the housing adjacent to the port;

the closing sleeve including a seal configured to engage with the sealing surface to form a fluid and pressure tight seal when the closing sleeve is in the closed position; and the protective sleeve is further configured to substantially cover the sealing surface when the closing sleeve is in the open position.

15. The well system of claim 13, the closing sleeve assembly further comprising:

a seal disposed in a recess formed in the housing;

the closing sleeve configured to engage with the seal to form a fluid and pressure tight seal when the closing sleeve is in the closed position; and the protective sleeve configured to substantially cover the seal when the closing sleeve is in the open position.

16. The well system of claim 13, the closing sleeve assembly further comprising a spring coupled to the protective sleeve and configured to exert a force on the protective sleeve in the direction of the port.

17. The well system of claim 13, wherein the protective sleeve further comprises a shoulder configured to engage with the housing to prevent the protective sleeve from extending to cover the port.

18. The well system of claim 13, wherein the closing sleeve is configured to contact the protective sleeve as the closing sleeve moves to the closed position causing the protective sleeve to retract away from the port.

19. The well system of claim 15, wherein the seal is positioned in a slot or groove formed in the housing adjacent to the port.

20. The well system of claim 13, wherein the protective sleeve includes at least one of an erosion resistant material or an erosion resistant coating.

* * * * *